US009694944B2

(12) United States Patent
Long et al.

(10) Patent No.: US 9,694,944 B2
(45) Date of Patent: Jul. 4, 2017

(54) DISPENSER FOR VISCOUS FOOD PRODUCTS

(75) Inventors: Robert Long, Glenview, IL (US); Barbara Long, legal representative, Glenview, IL (US); Edward Eaton, Eola, IL (US); Loren Veltrop, Chicago, IL (US); Eric Larson, Pecatonica, IL (US)

(73) Assignee: Prince Castle LLC, Carol Stream, IL (US)

( * ) Notice: Subject to any disclaimer, the term of this patent is extended or adjusted under 35 U.S.C. 154(b) by 0 days.

(21) Appl. No.: 13/413,608

(22) Filed: Mar. 6, 2012

(65) Prior Publication Data

US 2013/0233886 A1 Sep. 12, 2013

(51) Int. Cl.

| | |
|---|---|
| ***B65D 35/30*** | (2006.01) |
| ***B65D 35/08*** | (2006.01) |
| ***B65D 41/20*** | (2006.01) |
| ***B65D 75/58*** | (2006.01) |

(52) U.S. Cl.

CPC ..... *B65D 35/08* (2013.01); *B65D 35/30* (2013.01); *B65D 41/20* (2013.01); *B65D 75/5827* (2013.01)

(58) Field of Classification Search

CPC ..... B65D 5/747; B65D 41/32; B65D 35/30; B65D 35/08; B65D 41/50; B65D 41/505; B65D 51/20; B65D 51/22; B65D 75/5827; B65D 17/506; B65D 83/0055

USPC ... 222/107, 92, 569, 572, 574, 494, 95, 575, 222/541.3–541.6, 105, 212, 213, 214, 222/215, 490, 491, 1, 80–91; 383/104, 383/122, 67, 43, 123, 44

See application file for complete search history.

(56) References Cited

U.S. PATENT DOCUMENTS

| | | | | |
|---|---|---|---|---|
| 3,549,049 | A * | 12/1970 | Weber | 222/91 |
| 3,638,835 | A * | 2/1972 | Goodrich et al. | 222/107 |
| 4,469,250 | A * | 9/1984 | Evezich | B65D 83/0055 222/83.5 |
| 5,339,995 | A * | 8/1994 | Brown et al. | 222/173 |
| 5,421,485 | A | 6/1995 | Furuta et al. | |
| 5,429,273 | A * | 7/1995 | King | B05B 11/0043 222/105 |
| 5,443,181 | A * | 8/1995 | Popp et al. | 222/95 |
| 5,634,572 | A * | 6/1997 | Lane et al. | 222/95 |
| 6,079,594 | A * | 6/2000 | Brown et al. | 222/107 |
| 6,406,763 | B1 * | 6/2002 | Wolf et al. | 428/34.9 |
| 6,598,764 | B1 * | 7/2003 | Stern | 222/95 |
| 6,685,691 | B1 * | 2/2004 | Freund et al. | 604/403 |
| 6,759,071 | B2 * | 7/2004 | Nye et al. | 426/394 |
| 7,775,399 | B2 * | 8/2010 | Wood | 222/94 |

(Continued)

*Primary Examiner* — Frederick C Nicolas
*Assistant Examiner* — Bob Zadeh
(74) *Attorney, Agent, or Firm* — Andrus Intellectual Property Law, LLP

(57) ABSTRACT

A dispenser for viscous foods like condiments, batter and syrups employs a flexible plastic bag made of a flexible plastic material. The dispenser includes a cylinder having an annulus and defining an open interior. The cylinder receives the flexible plastic bag within the open interior. The cylinder includes a threaded nozzle that extends away from the open interior. A dispensing cap threadingly engages the threaded nozzle and includes a hollow tube and at least one knife edge which extends past the annulus into the open interior.

19 Claims, 8 Drawing Sheets

(56) References Cited

U.S. PATENT DOCUMENTS

| | | | | |
|---|---|---|---|---|
| 2003/0170356 | A1* | 9/2003 | Yuan et al. | 426/313 |
| 2004/0112915 | A1* | 6/2004 | Franczyk | 222/92 |
| 2004/0164043 | A1* | 8/2004 | Hakim | 215/11.5 |
| 2006/0016835 | A1* | 1/2006 | Perry | 222/494 |
| 2006/0065132 | A1* | 3/2006 | Jongen | B65D 83/0055 99/485 |
| 2008/0142545 | A1* | 6/2008 | Priolo et al. | 222/105 |
| 2009/0272767 | A1* | 11/2009 | Herman et al. | 222/326 |
| 2011/0006076 | A1* | 1/2011 | Williams | 222/95 |
| 2012/0065608 | A1* | 3/2012 | Costello et al. | 604/403 |

* cited by examiner

DISPENSER FOR VISCOUS FOOD PRODUCTS

A viscous food product is considered herein to include food products like pancake batter, syrups and various types of condiments that include mayonnaise, guacamole, ketchup and mustard. Such foods are often provided to restaurants and food service providers in rigid paper or plastic tubes. The food products are dispensed or served using sauce dispensing guns.

Many viscous food products are pasteurized or treated for consumption using high-pressure pasteurization. While prior art tubes and other rigid or semi-rigid containers might be well-suited to be used with sauce dispensing guns, they are ill-suited to be pressurized during high-pressure pasteurization. An apparatus and method for dispensing viscous foods that is both relatively clean and yet usable with high pressure pasteurization would be an improvement over the prior art.

DETAILED DESCRIPTION

Figure 1A:
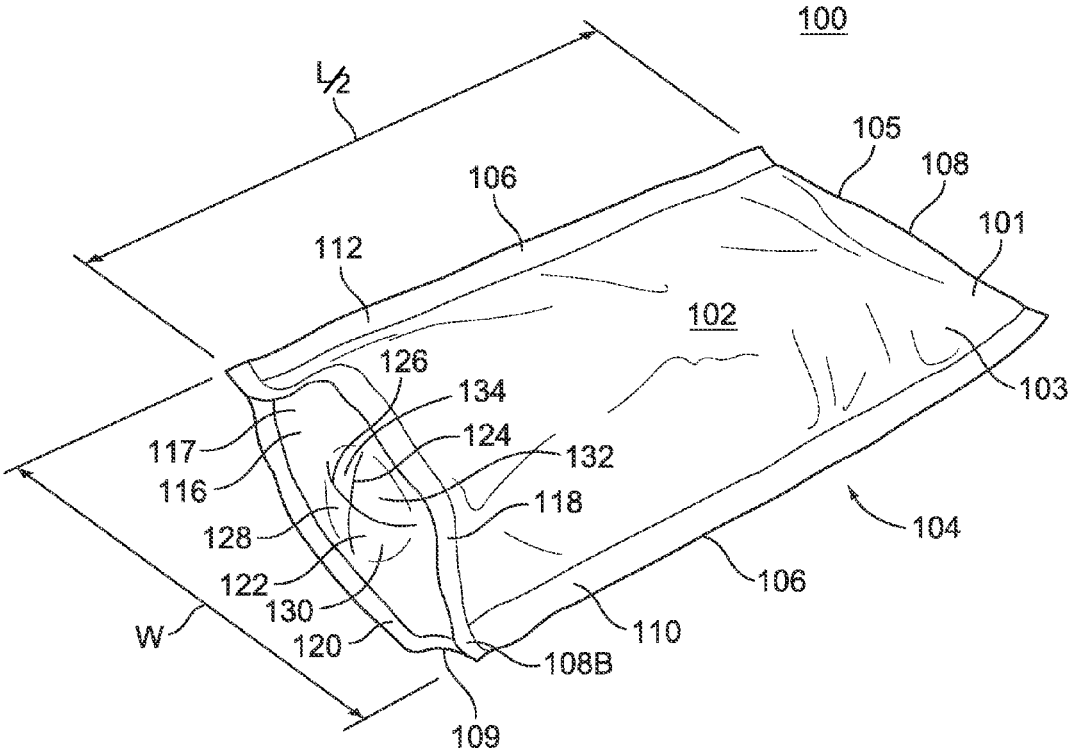
FIG. 1A is a perspective view of a flexible plastic bag for dispensing a viscous food product, such as a condiment.

FIG. 1A is a perspective view of a flexible plastic bag 100 for dispensing viscous food products and which is suitable for use with a viscous food product-dispensing gun. As used herein, the term, "viscous food product" includes condiments such as mayonnaise, ketchup, mustard and guacamole but it also includes pancake batter, syrups and the like.

Plastic bags can be formed in different ways but in the embodiment shown in FIG. 1, the bag 100 is comprised of a pair of comparatively tough yet flexible plastic panels 102 and 104 that are substantially rectangular in shape. The lower panel 104 is not visible in FIG. 1.

A single, elongated sheet 101 of a relatively tough flexible plastic having a length "L" is folded across the width "W" of the sheet at a location 105 along the length L of the sheet 101. Folding the sheet 101 along the width W can thus define two similarly-shaped rectangular panels 102 and 104. Each panel 102, 104 has two long edges 106 and two short edges 108 and 109. A first or "top" edge 108 is located where the sheet 101 is folded over itself. Each panel 102, 104 forms, and is considered herein to be a bag side wall. The bag sidewalls are thus also identified by reference numerals 102 and 104.

Each long edge 106 of a panel (102 or 104) is joined to a corresponding or mating long edge 106 of an "opposing" sidewall (104 or 102). The two sidewalls 102, 104 are joined to each other by the application of heat, an adhesive or both heat and adhesive, to an elongated, narrow strip of plastic material just inside and substantially parallel to each long edge 106. Adhesive is of course applied between the two sidewalls. The narrow strips where heat is applied, or where adhesive is applied between, defines seams 110, 112 that run parallel or substantially parallel to the long edges 106. The seams seal or enclose viscous food products inside the bag such that the bag can be pressurized in a high-pressure pasteurization process without having the bags rupture as a result of the pasteurization process.

As used herein, the term "seam" is considered to include either a line, groove, ridge or thickness, formed by the abutment, connection, attachment or overlap of two or more layers of plastic material, regardless of how the layers are abutted, connected attached or overlap. Seams can be formed using heat, adhesive or both heat and adhesive.

Figure 10A:
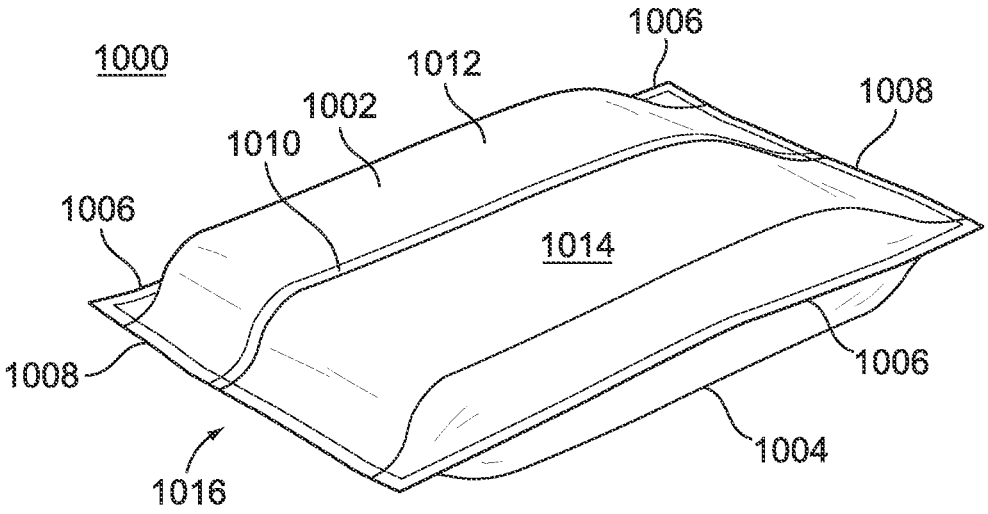
FIG. 10A is a perspective view of an alternate embodiment of a flexible plastic bag.
Figure 10B:
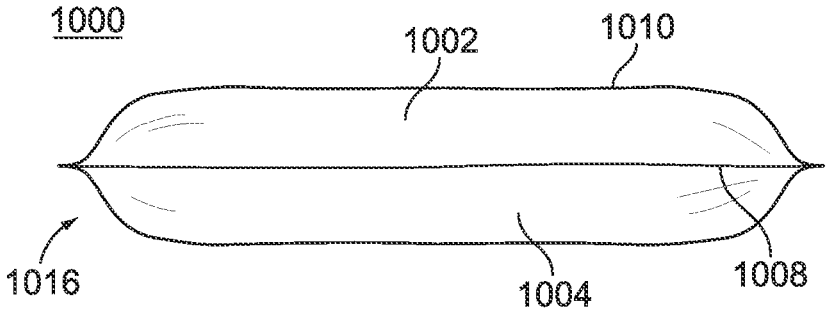
FIG. 10B is a side view of the bag shown in FIG. 10A.
Figure 10C:
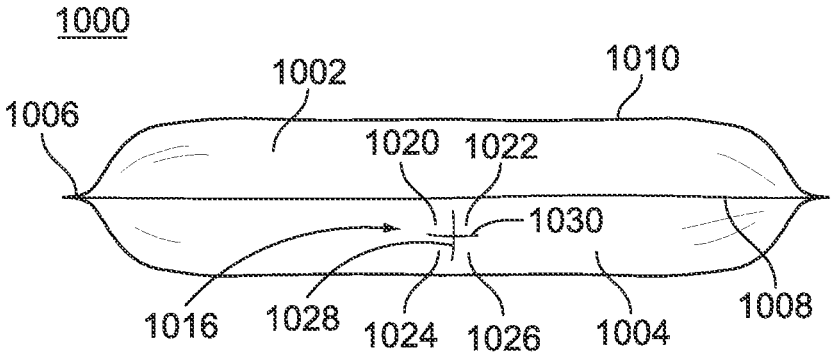
FIG. 10C is an end view of the bag shown in FIG. 10A.
Figure 11:
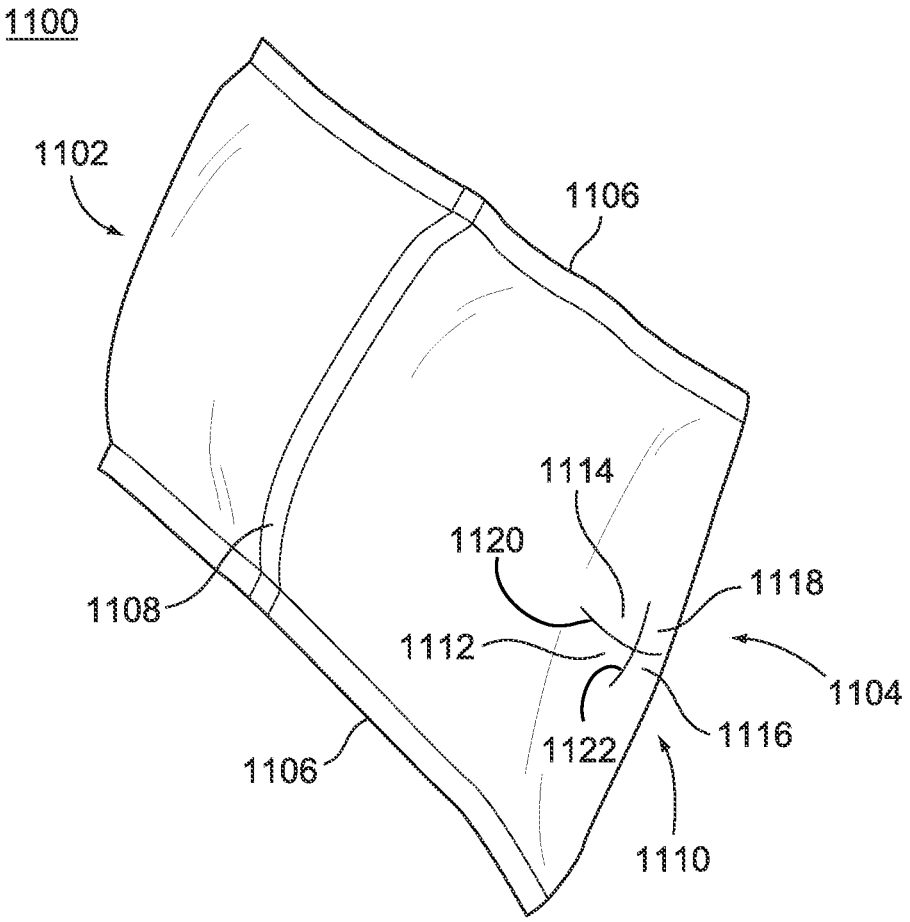
FIG. 11 is a perspective view of yet another alternate embodiment of a flexible plastic bag.

As stated above, and as shown in FIGS. 10 and 11, plastic bags can be formed in different ways. The bag shown in FIG. 1, however, is formed to have a bottom sidewall or wall 116, which is preferably formed from a portion 117 of one of the sidewalls 102 or 104.

Figure 1B:
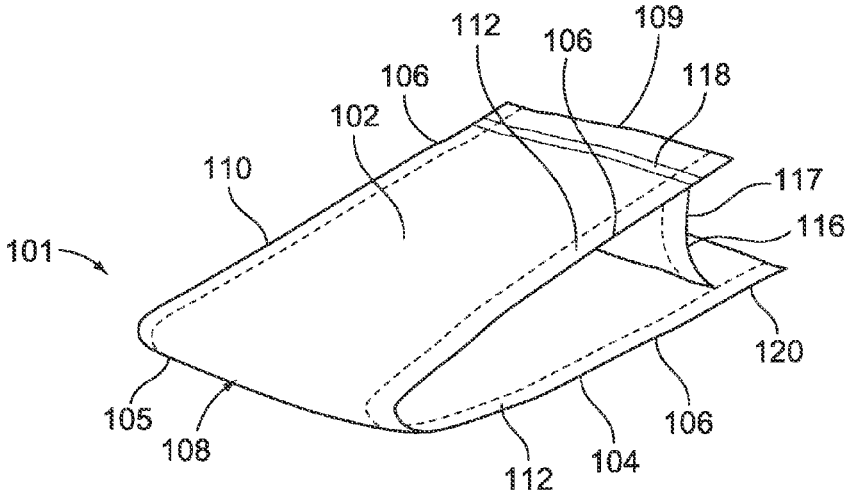
FIG. 1B is another perspective view of the bag shown in FIG. 1A and which shows the construction of the flexible plastic bag shown in FIG. 1A.

As can be seen in FIG. 1B, the bottom wall 116 of the bag 100 is formed by folding over a portion 117 of one of the side walls (102 or 104). The folded-over portion 117 of a sidewall is then "seamed" or attached to the other side wall (104 or 102) at two cross seams 118 and 120.

Regardless of how a bag is formed and regardless of whether a bag 100 is considered to have one wall, two walls 102 and 104 or three walls, 102, 104 and 116. At least one of the walls, or a portion of a wall, is formed or processed to have a self-sealing dispensing orifice, which is identified in the figures by reference numeral 122. The orifice 122 is preferably formed simply by cutting two slices 124 and 126 into the side wall or the side panel of a bag, such as the bag shown in FIG. 1.

Because a seam is comprised of two or more layers of plastic sheet, a seam will usually have mechanical characteristics that differ from the sheet material from which a seam is formed. The slices 124 and 126 that form the orifice 122 are therefore made at a location in a bag sidewall that is "away" from a seam. Stated another way, the slices 124 and 126 are formed so that they do not pass through a seam.

As used herein, the terms "away" and "away from" are considered to mean: absent from; spaced away from; or distant from. Locating the self-sealing dispensing orifice 122 to be "away" from a seam or seal thus means that the slices or cuts 124 and 126 that define the orifice 122 are located in a smooth portion of the sidewall and do not extend through a seam or seal or joint that connects sidewalls together.

A self-sealing dispensing orifice 122 is preferably embodied as four, flexible plastic triangular-shaped panels 128, 130, 132 and 134, defined by two, substantially orthogonal cuts 124 and 126 through the material from which a wall 102 or 104 of the bag 100 is made. The cuts 124 and 126 are preferably of equal lengths. The cuts 124 and 126 are also preferably orthogonal to each other. Forming the cuts 124 and 126 to be equal and forming the cuts 124 and 126 to be orthogonal to each other results in the four segments, the shapes of which are sectors of a circle but nevertheless referred to herein as triangular-shaped or substantially triangular-shaped panels having equal or at least substantially equal areas. The area of each panel is equal to one-half the length of a cut 124 and 126 multiplied by the square of the angle, measured in radians, that is between the cuts 124 and 126. Stated another way, the area, A of a panel 128, 130, 132 or 134 is equal to $$r^2\left[\frac{\theta}{2}\right]$$

where "r" is equal to one-half the total length of a cut 124 or 126 and θ is the angle between the two cuts expressed in radians. For cuts that are right angles to each other, θ is equal to ninety degrees or π/2.

When a viscous food product inside the cylinder is urged against the panels 128, 130, 132 and 134, the equal areas of the panels results in equal or at least substantially equal forces being applied to each of the different panels 128, 130, 132 and 134. Since the panels 128-134 consist of the same flexible yet resilient material from which the bag walls are made, the panels 128-134 will react or bend outwardly in substantially the same way. When a force applied to the panels from the viscous food product is removed, the panels 128-134 will return to their original shape in substantially the same way at substantially the same time.

The orifice 122 and its constituent panels 128-134 are considered herein to be part of a bag wall. Stated yet another way, a bag wall 102 or 104 forms part of the orifice 122. The material from which the bag 100 is made is relatively resilient.

The orifice 122 formed by the panels 128-134 is considered to be "self-sealing" because the stiffness of the material from which the bag walls and panels 128-134 are made causes the panels 128-134 to return to their original shapes and because the slices or cuts 124 and 126 that define the panels 128-134 are formed to be too for the particular food product in the bag 100 to flow through the slices or cuts 124 and 126. The panels 128-134 thus open responsive to an applied force supplied by a viscous food product but then close themselves when the deflection force is removed. The efficacy of the self-sealing orifice 122, i.e., the tightness of the orifice 122, will thus depend on the resilience or stiffness of the material from which the bag wall is formed, the thickness of the material from which the sidewalls are formed, the width of the cuts or slices 124, 126 and the viscosity of the material to be dispensed.

Figure 2:
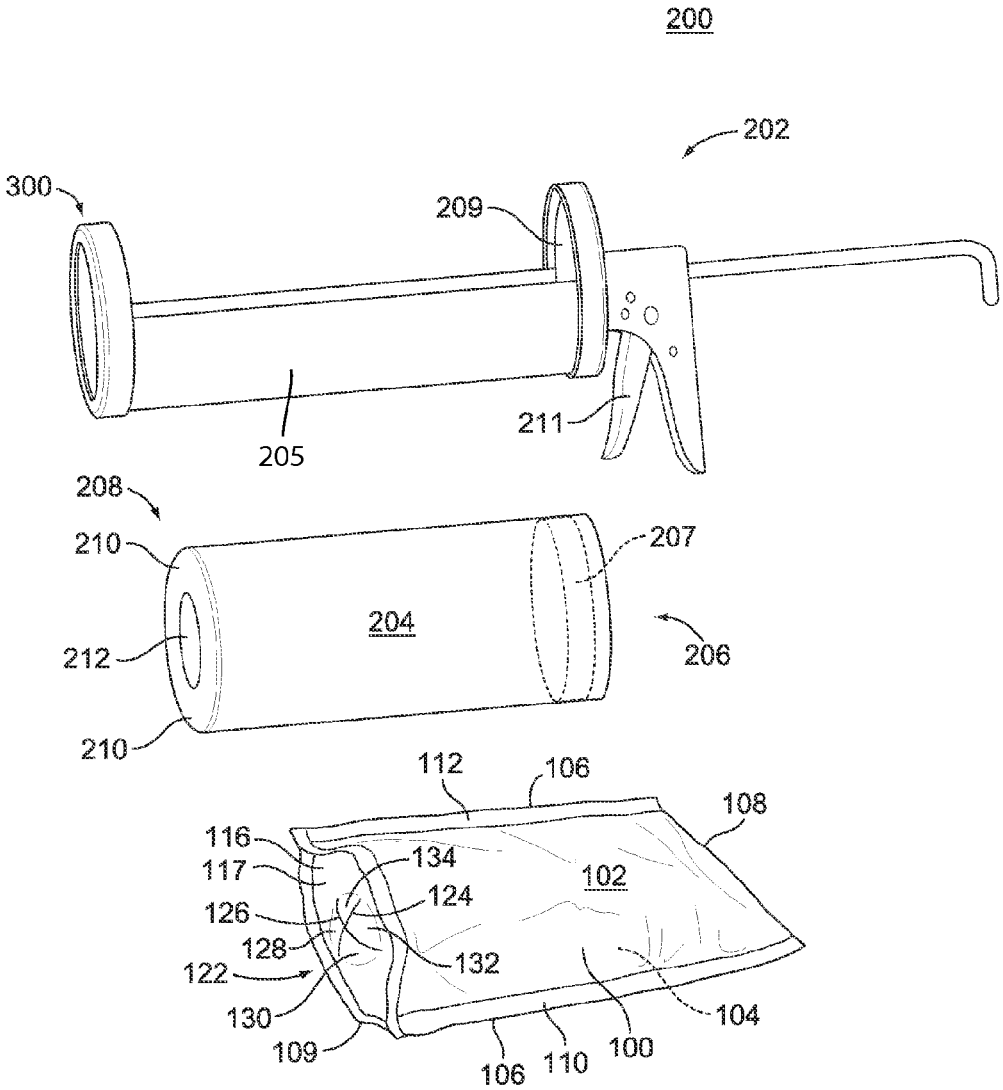
FIG. 2 is an exploded view of a viscous food product-dispensing gun, a flexible plastic cylinder that fits inside the gun and a flexible bag for holding viscous food product material to be dispensed using the gun.

FIG. 2 is an exploded view of a viscous food/condiment dispenser 200 comprised of a condiment dispensing gun 202, a hollow flexible cylinder 204 and a flexible, viscous food product-containing bag, such as the bag 100 depicted in FIG. 1. The cylinder 204 is sized, shaped, and arranged to fit within a cradle 205 of the dispensing gun 202 but it is also configured to receive inside the cylinder 204 a flexible, viscous food product-containing bag through an "open" end 206. It is also configured to be readily assembled into the gun 202 and removed therefrom without tools.

The cylinder 204 has a "second" end 208, which is partially "closed." The second end 208 of the cylinder 204 is considered to be partially closed because the second end 208 is formed to have a hole or opening 212. When viewed head on, the second end 208 of the cylinder 204 has a shape reminiscent of an annulus in that the second end 208 has a ring or ring-like flange identified in the figure by reference numeral 210, which surrounds a circular opening 212. The opening 212 is large enough to encircle the panels 128-134 of the self-sealing orifice 122 and thus open and close responsive to force applied to and removed from the panels. The opening 212 also allows a corresponding portion of the bag wall to extend outwardly from the opening 212 by a small distance and be kept taught or slightly stretched.

FIG. 2 shows a "first" piston 207 inside the cylinder 204. In one embodiment, the piston 207 in the cylinder 204 is driven by a second piston 209 associated with the gun 202 itself and which is driven by actuation of a spring-loaded trigger 211. In another embodiment, the first piston 207 is omitted; the second piston 209 is the only piston that drives the bag 100 and viscous food product it contains toward the opening 212.

Figure 3:
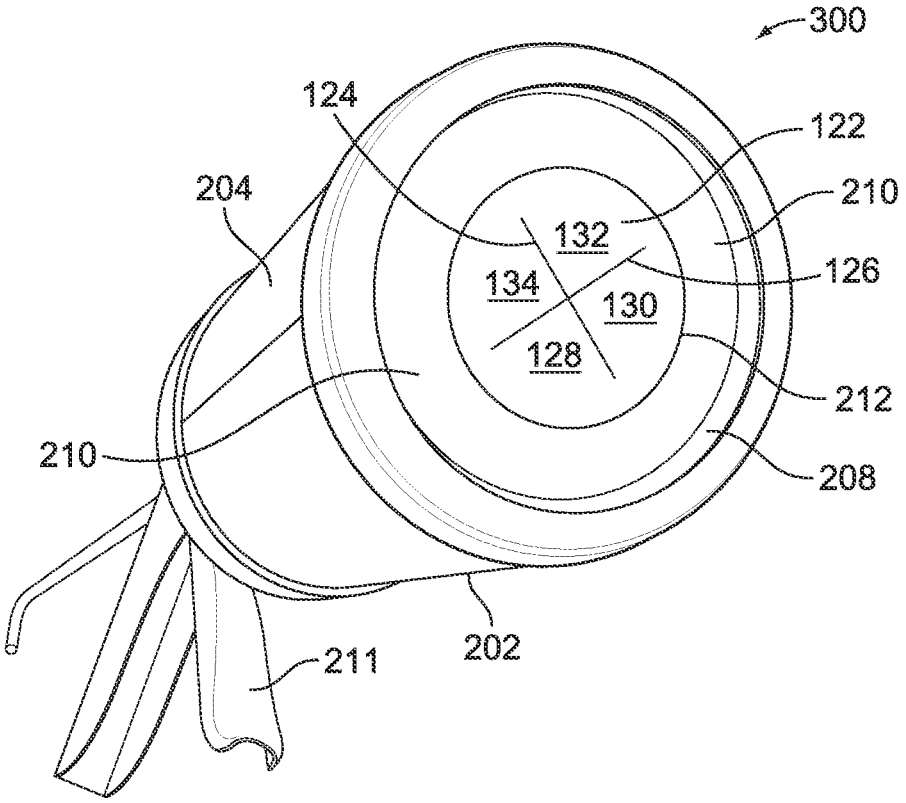
FIG. 3 is an end view of the viscous food product-dispensing gun shown in FIG. 2.

When the bag 100 is placed into the tube 204, the circular opening 212 in the second end 208 "exposes" the panels 128-134 of the self-sealing orifice 122. Stated another way, the orifice 122 and its constituent panels 128-134 are "aligned with" or centered in the opening 212, as can be seen in FIG. 3 for example. Squeezing viscous food product in the bag using a piston that approaches the bag 100 from the first end 206 of the cylinder 204 drives food product out of the panels 128-134.

The opening 212 is considered to be surrounded by a ring-like area 210, which is referred to hereinafter as an annulus 210. The annulus holds the bag 100 in the cylinder 204, especially when the piston 207 pushes the bag 100 and its contents toward the second end 208 of the cylinder 204. Stated another way, the annulus 210 at the second end 208 of the tube 204 surrounds the dispensing orifice 212 yet retains the bag 100 inside the tube 204 as the bag 100 is compressed by a piston 207 driven through the cylinder 204 by a corresponding piston 209 of the gun 202.

FIG. 3 is an isolated view of the dispensing end 300 of the gun 202. The second end 208 of the tube 204 can be seen as having an annulus 210 that defines a circular opening 212 through which viscous material from inside the bag 100 can be discharged through the self-sealing orifice 122. The opening 212 in the second end 208 of the cylinder 204 is "aligned" to surround the self-sealing dispensing orifice 122 formed in the bottom of the bag 100 and its constituent panels 128-134.

Figure 4:
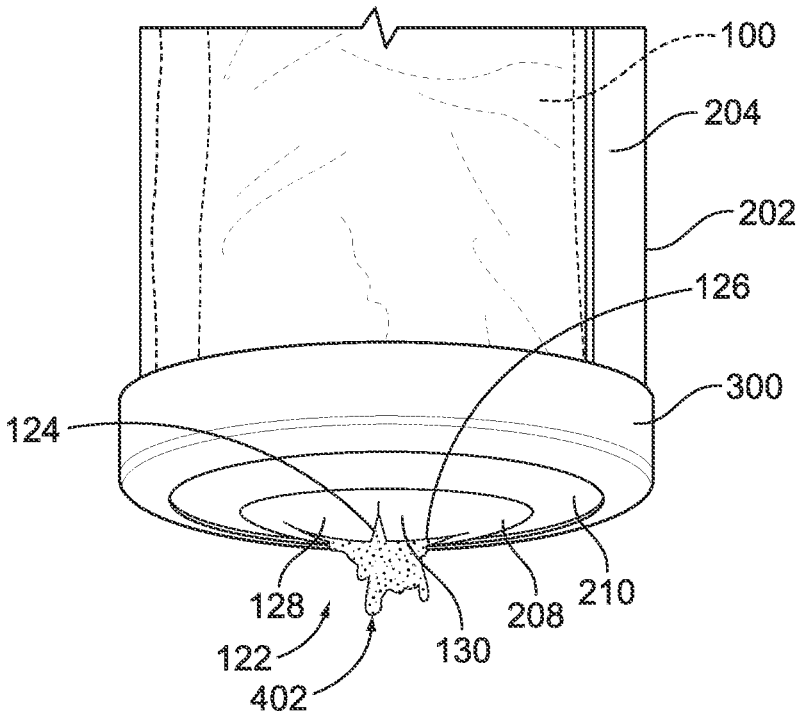
FIG. 4 is an isolated view of the top of the viscous food product-dispensing gun with the flexible tube installed therein and with the flexible bag in the flexible tube shown in phantom lines.

FIG. 4 is another isolated view of the dispensing end 300 of the gun 202. The bag 100, which is shown in phantom lines, extends outwardly a small distance from the opening 212 and the second end 208 of the cylinder 204. Viscous material 402 can be seen being dispensed from the self-sealing dispensing orifice 122 formed in the wall of the bag 100.

Figure 5:
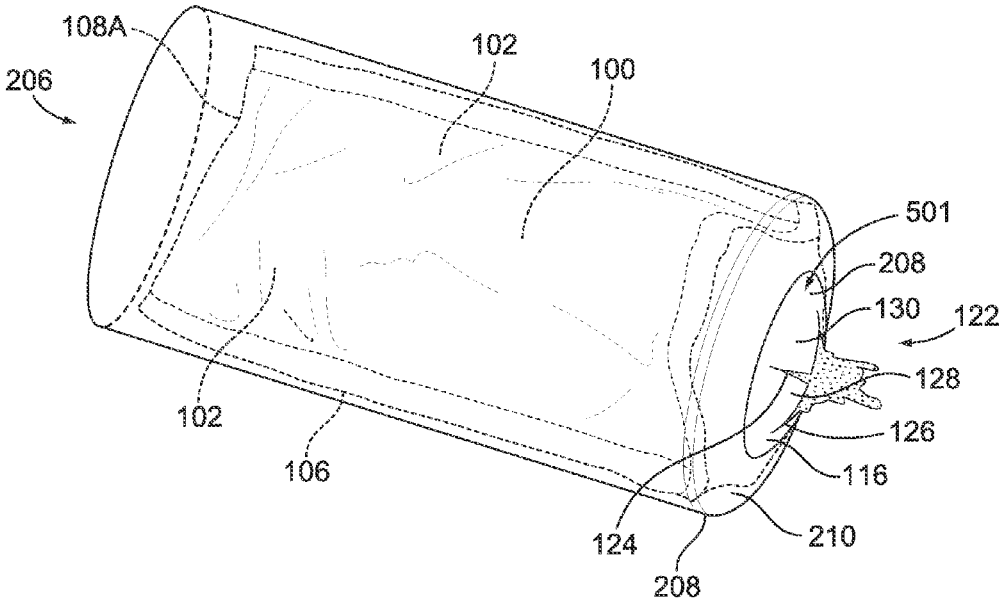
FIG. 5 is an isolated view of the cylinder shown in FIG. 2 and showing the flexible bag in phantom lines.

FIG. 5 is a perspective view of the cylinder 204 showing the first open end 206 in phantom lines and showing the partially-closed second end 208. Phantom lines show the bag 100 inside the cylinder 204. A portion 501 of a bag wall with the self-sealing orifice 122 projects outwardly from the opening 212 by a small distance owing to the fact that the contents of the bag and the bag itself are subjected to pressure applied to the bag and its contents by a piston inside the cylinder 204. The portion 501 that projects outwardly from the opening 212, and which is stretched or taught, has a shape reminiscent of a segment of a sphere.

Figure 6:
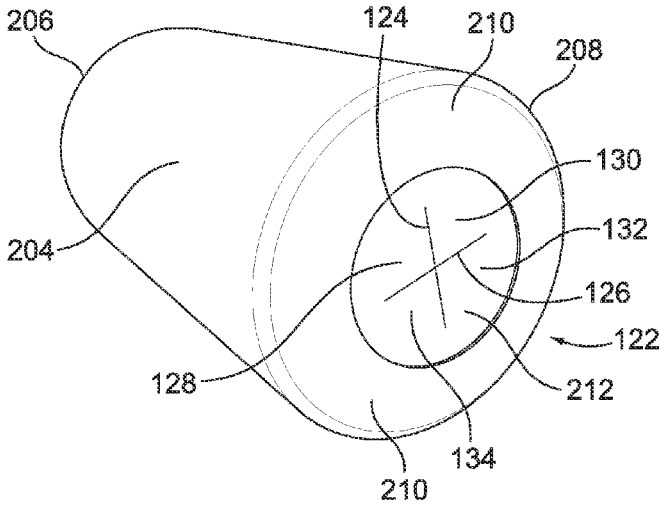
FIG. 6 is an end view of the cylinder show in FIG. 5.

FIG. 6 is an end view of the cylinder 204 showing in greater detail the annulus 210 at the second end 208 of the cylinder 204. The annulus defines a hole or opening 212 to which the self-sealing orifice 122 in the wall of the bag 100, is aligned.

Figure 7:
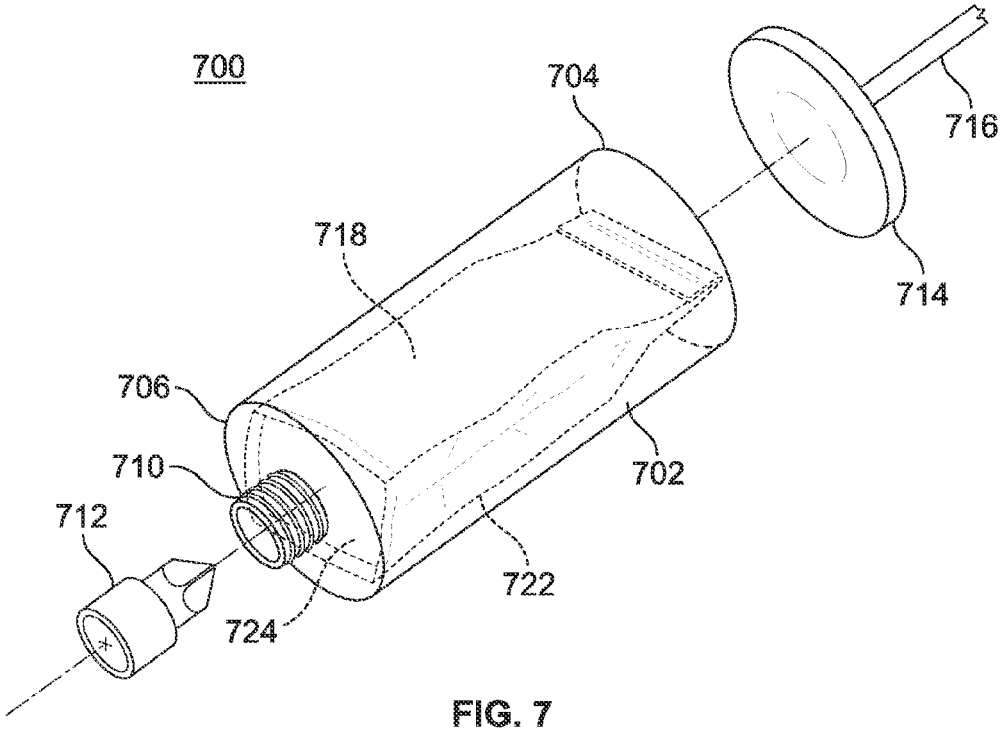
FIG. 7 is a perspective view of an alternate embodiment of a flexible plastic cylinder for use with a dispensing gun and holding a flexible plastic tube filled with viscous food product.

FIG. 7 is a perspective view of an alternate embodiment of a viscous food product dispenser 700. The dispenser 700 is comprised of a thin, substantially cylindrical, flexible plastic tube 702 having an open end 704 and a closed end 706. The open end is sized and configured to receive a flexible bag that contains a viscous-food product and to thereafter receive a piston 714. The second, closed end 706 is provided with a threaded nozzle 710 to which a threaded dispensing cap 712 is attached by screwing the cap 712 on to the threads of the nozzle 710. The threaded dispensing cap 712 is formed to have a hollow tube 801, (See FIG. 8.) the distal end of which is cut or shaped to provide "knife" edges 802 that can penetrate a flexible plastic bag. (See FIG. 8.)

A flexible plastic bag 718 similar to the bag shown in FIG. 1 is placed into the tube 702. The bag 718 is comprised of two opposing side walls or side panels 720 and 722 and a bottom wall or panel 724 formed from one of the sidewalls 720 and 722 as described above. As with the bag depicted in FIG. 1, the bottom sidewall 724 is smooth. When the bag 718 is placed into the tube 702 it is forced downwardly in the tube by the piston 714 to where it comes to rest at the closed or second end 706 of the cylinder.

Figure 8:
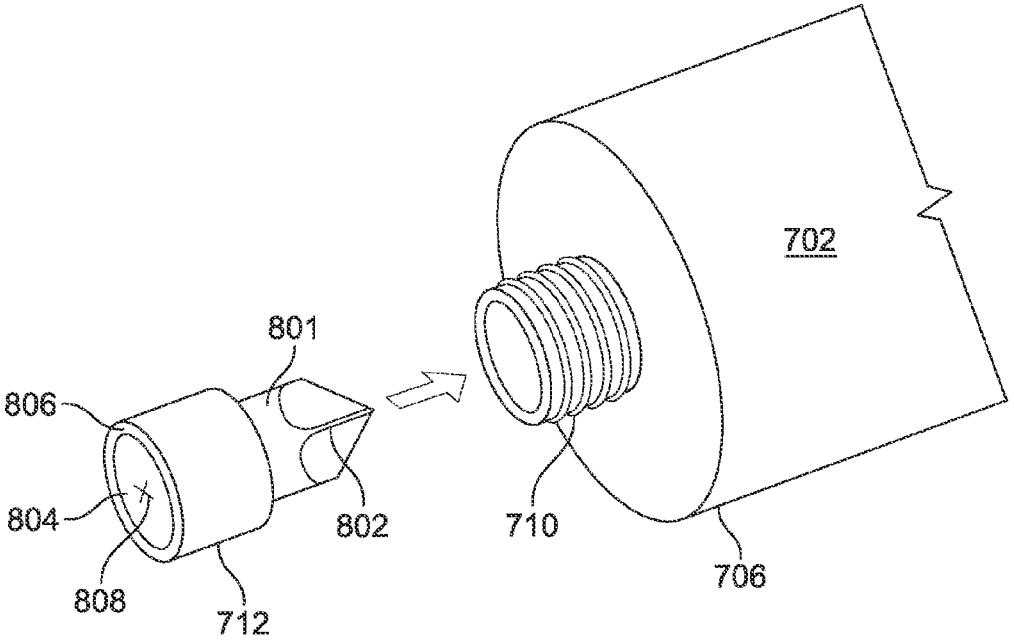
FIG. 8 is an isolated view of the dispensing end of the cylinder shown in FIG. 7.

FIG. 8 is an isolated view of the dispensing cap 712 and threaded nozzle 710. The cap 712 is provided with a hollow dispensing tube 801 the distal end of which is shaped to have a four-blade knife 802. When the cap 712 is threaded onto the nozzle, 710, the dispensing tube 801 is long enough to extend through the length of the threaded nozzle 710 and into the interior of the tube 702. The length of tube 801 and its included knife 802 is also long enough to have the knife 802 pierce the "bottom" sidewall 724 of the bag 718 when the bag 718 is driven against the knife 802 by a piston 714 and piston rod 716 of a dispensing gun. Viscous foods in the bag 718 can thus be driven from the bag 718 by force exerted on the bag 718 and its contents by a piston 714 and the piston rod 716, which are driven by a conventional dispensing gun mechanism. A cross-cut 804 formed in the top 806 of the cap 712 provides a self-sealing viscous-food product dispensing orifice 808, the operation of which is the same as the orifice 122 described above.

Figure 9:
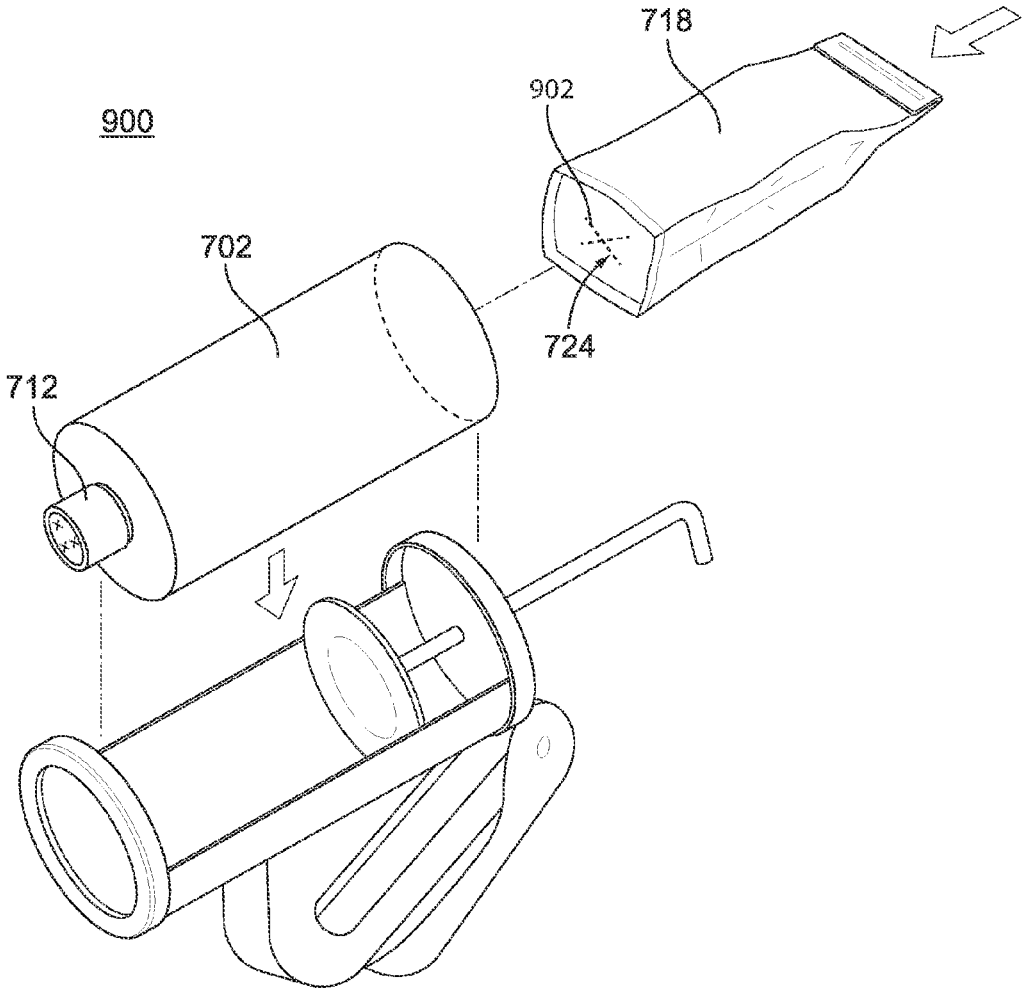
FIG. 9 is an exploded view of a dispensing gun with the cylinder and viscous food product bag of FIGS. 7 and 8.

FIG. 9 is an exploded view of the viscous food product dispenser 900. It is comprised of the tube 702 and bag 718 shown in FIG. 7 and a viscous food product dispensing gun 902. The bag 718 and tube are configured to allow the bag 718 to be inserted into the tube 702. A piston rod 716 driven by a conventional drive mechanism of the gun 900 pushes a piston 714 into the open end 704 of the tube 702. The blade 802 on the cap 712 provides a cross cut in the bottom of the bag 718 forming a self-sealing orifice 902 therein.

FIG. 10A is a perspective view of another embodiment of a bag 1000 configured to be used with the gun 200 shown in FIG. 2 or variants thereof. FIG. 10B is a side view. FIG. 10C is an end view.

A top sheet 1002 of plastic is attached to a similarly-shaped bottom sheet 1004 by seams formed along two long edges 1006 and two short edges 1008. A fill seam 1010 in the top sheet 1002 is formed by joining two portions 1012, 1014 of the top sheet 1002 after the bag 1000 is filled.

After the bag 1000 shown in FIGS. 10A and 10B is filled, four panels 1020, 1022, 1024 and 1026 are formed into bottom sheet 1004 to form a self-sealing orifice 1016. The orifice 1016 and the panels 1020, 1022, 1024 and 1026 are formed by cutting two, substantially equal-length, orthogonal slices 1026 and 1028 through the bottom sheet 1004 at a location that is below the fill seam 1010 but in the bottom sheet 1004.

FIG. 11 is an isometric view of yet another embodiment of a flexible bag 1100. The bag 1100 has two smooth, seamless ends 1102 and 1104 formed by wrapping or folding a single sheet of plastic back on itself twice. The long edges 1106 are seamed as described above. A fill seam 1108 is formed by joining the two, folded back portions. A self-sealing orifice 1110 in the bag 1100 consists of four panels 1112, 1114, 1116 and 1118, which are formed by two, equal-length slices or cuts 1120 and 1122 through the smooth end 1104 of the bag 1100.

The bag shown in FIG. 1 and the bags shown in FIGS. 10-11 can be sealed at or by one or more seams after being "filled" with a viscous food product. The bags' material, the seams and their construction enable the bags and enclosed content to be pasteurized using high-pressure pasteurization.

The foregoing description if for purposes of illustration only. The true scope of the invention is set forth in the appurtenant claims.

What is claimed is:

1. A viscous food dispenser comprising:

a cylinder having a first end and a second end, the first end being open, the second end comprising an annulus and a threaded nozzle, the cylinder further having an interior surface that defines an open interior, the threaded nozzle extending from the annulus away from the open interior;

a dispensing cap threadingly engaged with the threaded nozzle and extending away from the annulus, the dispensing cap further comprising a hollow tube and at least one knife edge extending past the annulus into the open interior;

a piston removably received within the open interior through the first end to slidingly engage the interior surface of the cylinder;

a flexible bag configured to hold a viscous food, the flexible bag disposed within the open interior of the cylinder;

a self-sealing orifice located in the dispensing cap and configured to dispense the viscous food therethrough;

a dispensing end comprising a dispensing annulus, the dispensing end orientated to restrain the second end of the cylinder;

a cradle connected to the dispensing end, the cradle configured to removably receive the cylinder in engagement with the dispensing annulus;

a spring-loaded trigger, mechanically actuatable to create a dispending force; and a piston rod configured to engage the piston, the piston rod moveable in response to actuation of the spring loaded trigger;

wherein the flexible bag engages the annulus of the cylinder to support the flexible bag as the at least one knife edge of the dispensing cap pierces the flexible bag and the piston engages the flexible bag such that a force applied to the piston causes an amount of viscous food in the open interior of the cylinder proportionate to the force applied to exit the flexible bag through the second end of the cylinder and the hollow tube of the dispensing cap.

2. The viscous food dispenser in claim 1, wherein the flexible bag engages the annulus and interior surface of the cylinder, the annulus and interior surface rigidly support the flexible bag such that the force applied to the piston is transferred to the viscous material.

3. The viscous food dispenser in claim 1, wherein the self-sealing orifice opens to dispense the amount of the viscous food and self-seals when a pressure within the flexible bag from the applied force is alleviated.

4. The viscous food dispenser of claim 3, wherein the self-sealing orifice comprises a plurality of flexible panels defined by cross cuts the flexible panels deflect outward in response to the applied force applied to the flexible container through the piston, and the flexible panels return to their original positions when the applied force is alleviated.

5. The viscous food dispenser of claim 1, wherein the piston is a first piston and further comprising a second piston secured to the piston rod and selectively engaged with the first piston.

6. The viscous food dispenser of claim 1, wherein the at least one knife edge of the dispensing cap comprises four perpendicularly oriented knife edges.

7. The viscous food dispenser of claim 1, wherein the flexible bag comprises at least first and second sidewalls joined together by at least first and second seams and the at least one knife edge pierces the flexible bag away from the first and second seams.

8. The viscous food dispenser of claim 1, wherein the flexible bag is constructed of a material that is capable of withstanding high-pressure pasteurization.

9. A method of dispensing a viscous food, the method comprising:

providing a cylinder having a first end and a second end, the first end being open, the second end comprising an annulus and a threaded nozzle, the cylinder further having an interior surface that defines an open interior, the threaded nozzle extending from the annulus away from the open interior;

providing a dispensing cap comprising a hollow tube, a self-sealing orifice, and at least one knife edge;

providing a dispensing gun comprising:

a piston removably received within the open interior through the first end to slidingly engage the interior surface of the cylinder;

a dispensing end comprising a dispensing annulus, the dispensing end orientated to restrain the second end of the cylinder;

a cradle connected to the dispensing end, the cradle configured to removably receive the cylinder in engagement with dispensing annulus;

a spring-loaded trigger, mechanically actuatable to create a dispensing force; and a piston rod configured to engage the piston, the piston rod moveable in response to actuation of the spring loaded trigger; and providing a flexible bag filled with a viscous food;

threadingly engaging the dispensing cap with the threaded nozzle of the cylinder, the at least one knife edge extending past the annulus of the cylinder into the open interior;

receiving the flexible bag filled with the viscous food within the open interior of the cylinder;

engaging the flexible bag with the piston;

engaging the annulus of the cylinder with the flexible bag;

engaging the piston with the piston rod;

piercing the flexible bag with the at least one knife edge to open the flexible bag to flow of the viscous food into the hollow tube;

transferring a dispensing force from the piston rod, through the piston into the viscous food within the flexible bag; and dispensing an amount of viscous food from the flexible bag through the hollow tube and self-sealing orifice of the dispensing cap.

10. The method of claim 9, further comprising:

rigidly engaging the flexible bag with the interior surface and annulus of the cylinder and piston of the dispensing system such that the applied force is transferred through the viscous material to the self-sealing orifice.

11. The method of claim 9, wherein piercing the flexible bag comprises driving the flexible bag against the at least one knife edge with the piston by actuation of the spring-loaded trigger.

12. A viscous food dispenser comprising:

a cylinder having a first end and a second end, the first end being open, the second end comprising an annulus and a threaded nozzle, the cylinder further having an interior surface that defines an open interior, the threaded nozzle extending from the annulus away from the open interior;

a dispensing cap threadingly engaged with the threaded nozzle and extending away from the annulus of the cylinder, the dispensing cap further comprising a hollow tube and at least one knife edge extending past the annulus into the open interior;

a piston removably received within the open interior through the first end to slidingly engage the interior surface of the cylinder;

a flexible bag configured to hold a viscous food, the flexible bag disposed within the open interior of the cylinder and engaged with the annulus of the cylinder, the flexible bag comprising a self-sealing orifice therethrough created by the at least one knife edge extending past the annulus into the open interior and through the flexible bag;

a dispensing end comprising a dispensing annulus, the dispensing end orientated to restrain the second end of the cylinder;

a cradle connected to the dispensing end, the cradle configured to removably receive the cylinder in engagement with a dispensing annulus;

a spring-loaded trigger, mechanically actuatable to create a dispensing force;

a piston rod configured to engage the piston, the piston rod moveable in response to actuation of the spring loaded trigger.

13. The viscous food dispenser in claim 12, wherein the flexible bag engages the annulus of the cylinder and the piston engages the flexible bag such that a force applied to the piston causes an amount of viscous food in the open interior of the cylinder proportionate to the force applied to exit the flexible bag through the second end of the cylinder, and the hollow tube of the dispensing cap.

14. The viscous food dispenser in claim 13, wherein the flexible bag engages the annulus and interior surface of the cylinder, the annulus and interior surface rigidly support the flexible bag such that the force applied to the piston is transferred to the viscous food within the flexible bag.

15. The viscous food dispenser of claim 12, wherein the self-sealing orifice comprises a plurality of flexible panels defined by cross cuts, the flexible panels deflect outward in response to the applied force applied to the flexible container through the piston, and the flexible panels return to their original positions when the applied force is alleviated.

16. The viscous food dispenser of claim 12, wherein the piston is a first piston and further comprising a second piston secured to the piston rod and selectively engaged with the first piston.

17. The viscous food dispenser of claim 12, wherein the at least one knife edge of the dispensing cap comprises four perpendicularly oriented knife edges.

18. A method of dispensing a viscous food, the method comprising:

providing a cylinder having a first end and a second end, the first end being open, the second end comprising an annulus and a threaded nozzle, the cylinder further having an interior surface that defines an open interior, the threaded nozzle extending from the annulus away from the open interior;

providing a dispensing cap comprising a hollow tube and at least one knife edge;

providing a dispensing gun comprising:

a piston removably received within the open interior through the first end to slidingly engage the interior surface of the cylinder;

a dispensing end comprising a dispensing annulus, the dispensing end orientated to restrain the second end of the cylinder;

a cradle connected to the dispensing end, the cradle configured to removably receive the cylinder in engagement with dispensing annulus;

a spring-loaded trigger, mechanically actuatable to create a dispensing force; and a piston rod configured to engage the piston, the piston rod moveable in response to actuation of the spring loaded trigger; and providing a flexible bag filled with a viscous food;

threadingly engaging the dispensing cap with the threaded nozzle of the cylinder, the at least one knife edge extending past the annulus into the open interior;

receiving the flexible bag filled with viscous food within the open interior of the cylinder;

engaging the annulus of the cylinder with the flexible bag;

engaging the flexible bag with the piston;

engaging the piston with the piston rod;

piercing the flexible bag with the at least one knife edge to create a self-sealing orifice in the flexible bag and open the flexible bag to flow of the viscous food through the self-sealing orifice into the hollow tube;

transferring a dispensing force from the piston rod, through the piston into the viscous food within the flexible bag;

dispensing an amount of viscous food from the flexible bag through the hollow tube of the dispensing cap.

19. The method of claim 18, further comprising:

rigidly engaging the flexible bag with the interior surface and annulus of the cylinder and piston of the dispensing gun such that the applied force is transferred through the viscous food to the self-sealing orifice.

* * * * *